US011784402B2

(12) United States Patent
Yoshikawa

(10) Patent No.: US 11,784,402 B2
(45) **Date of Patent: *Oct. 10, 2023**

(54) ANTENNA, WIRELESS COMMUNICATION MODULE, AND WIRELESS COMMUNICATION DEVICE

(71) Applicant: KYOCERA Corporation, Kyoto (JP)

(72) Inventor: Hiromichi Yoshikawa, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 147 days.

This patent is subject to a terminal disclaimer.

(21) Appl. No.: 17/288,892

(22) PCT Filed: Oct. 25, 2019

(86) PCT No.: PCT/JP2019/042060

§ 371 (c)(1),
(2) Date: Apr. 26, 2021

(87) PCT Pub. No.: WO2020/090693

PCT Pub. Date: May 7, 2020

(65) Prior Publication Data

US 2022/0006181 A1 Jan. 6, 2022

(30) Foreign Application Priority Data

Oct. 31, 2018 (JP) ..... 2018-205980

(51) Int. Cl.
*H01Q 1/52* (2006.01)
*H01Q 5/35* (2015.01)
(Continued)

(52) U.S. Cl.
CPC ..... *H01Q 1/521* (2013.01); *H01Q 5/35* (2015.01); *H01Q 9/0421* (2013.01); *H01Q 21/065* (2013.01)

(58) Field of Classification Search
CPC ..... H01Q 1/521; H01Q 5/35; H01Q 9/0421; H01Q 21/065
See application file for complete search history.

(56) References Cited

U.S. PATENT DOCUMENTS 4,827,271 A 5/1989 Berneking et al.
10,033,088 B2 7/2018 Zhang et al.
(Continued)

FOREIGN PATENT DOCUMENTS

CN 105210232 A 12/2015
EP 2940795 A1 11/2015
JP 2017504274 A 2/2017

*Primary Examiner* — Dieu Hien T Duong
(74) *Attorney, Agent, or Firm* — HAUPTMAN HAM, LLP

(57) ABSTRACT

An antenna includes a first antenna element, a second antenna element, and a first coupler. The first antenna element includes a first radiation conductor and a first feeder line and resonates in a first frequency band. The second antenna element includes a second radiation conductor and a second feeder line and resonates in a second frequency band. The second feeder line is coupled to the first feeder line such that a first component, which is one of a capacitance component and an inductance component, is dominant. The first coupler couples the first and second feeder lines such that a second component different from the first component is dominant. The first and second radiation conductors are arranged at an interval of ½ or less of a resonance wavelength in a first direction. The first and second radiation conductors are arranged to be shifted in a second direction intersecting the first direction.

20 Claims, 12 Drawing Sheets

(51) Int. Cl.
*H01Q 9/04* (2006.01)
*H01Q 21/06* (2006.01)

(56) References Cited

U.S. PATENT DOCUMENTS

| | | | | |
|---|---|---|---|---|
| 2006/0044196 | A1* | 3/2006 | Grant | H01Q 9/42 343/711 |
| 2010/0159857 | A1* | 6/2010 | Kling | H01Q 19/00 455/127.1 |
| 2012/0306718 | A1 | 12/2012 | Koyanagi et al. | |
| 2013/0057438 | A1 | 3/2013 | Satou et al. | |
| 2015/0255849 | A1 | 9/2015 | Sumiyosi et al. | |
| 2016/0294062 | A1 | 10/2016 | Lo Hine Tong et al. | |
| 2017/0012345 | A1 | 1/2017 | Zhang et al. | |
| 2017/0084990 | A1 | 3/2017 | Le Thuc et al. | |
| 2017/0244149 | A1 | 8/2017 | Kim et al. | |
| 2021/0359418 | A1* | 11/2021 | Yoshikawa | H01Q 21/28 |
| 2021/0399435 | A1* | 12/2021 | Yoshikawa | H01Q 1/521 |

* cited by examiner

ANTENNA, WIRELESS COMMUNICATION MODULE, AND WIRELESS COMMUNICATION DEVICE

CROSS-REFERENCE TO RELATED APPLICATIONS

This application is a National Stage of PCT international application Ser. No. PCT/JP2019/042060 filed on Oct. 25, 2019 which designates the United States, incorporated herein by reference, and which is based upon and claims the benefit of priority from Japanese Patent Application No. 2018-205980 filed on Oct. 31, 2018, the entire contents of which are incorporated herein by reference.

FIELD

The present disclosure relates to an antenna, a wireless communication module, and a wireless communication device.

BACKGROUND

In an array antenna, an antenna for multiple-input multiple-output (MIMO), and the like, a plurality of antenna elements are arranged close to each other. When the plurality of antenna elements are arranged close to each other, mutual coupling between the antenna elements can be increased. When the mutual coupling between the antenna elements is increased, radiation efficiency of the antenna elements may decrease.

Therefore, a technique for reducing the mutual coupling between the antenna elements has been proposed (for example, Patent Literature 1).

CITATION LIST

Patent Literature

Patent Literature 1: JP 2017-504274 A

SUMMARY

An antenna according to an embodiment of the present disclosure includes a first antenna element, a second antenna element, and a first coupler. The first antenna element includes a first radiation conductor and a first feeder line and is configured to resonate in a first frequency band. The second antenna element includes a second radiation conductor and a second feeder line and is configured to resonate in a second frequency band. The second feeder line is configured to be coupled to the first feeder line such that a first component is dominant. The first component is one of a capacitance component and an inductance component. The first coupler is configured to couple the first feeder line and the second feeder line such that a second component different from the first component is dominant. The first radiation conductor and the second radiation conductor are arranged at an interval equal to or less than ½ of a resonance wavelength in a first direction. The first radiation conductor and the second radiation conductor are arranged to be shifted in a second direction intersecting the first direction.

A wireless communication module according to an embodiment of the present disclosure includes the above-described antenna and an RF module. The RF module is configured to be electrically connected to at least one of the first feeder line and the second feeder line.

A wireless communication device according to an embodiment of the present disclosure includes the above-described wireless communication module and a battery. The battery is configured to supply power to the wireless communication module.

DESCRIPTION OF EMBODIMENTS

Figure 1:
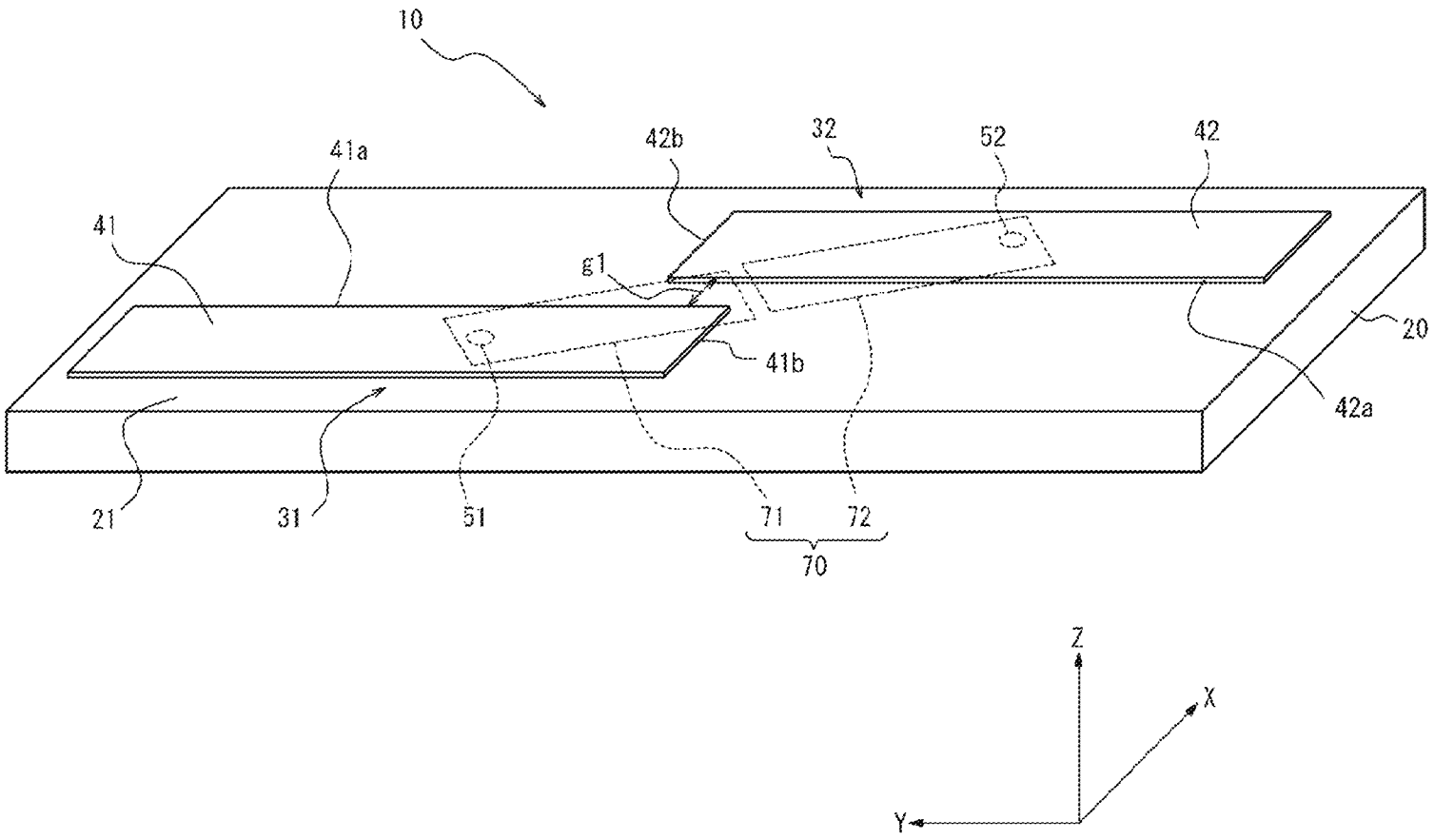
FIG. 1 is a perspective view of an antenna according to an embodiment.

There is room for improvement in the conventional technique for reducing mutual coupling between the antenna elements.

The present disclosure relates to providing an antenna, a wireless communication module, and a wireless communication device with reduced mutual coupling between antenna elements.

According to the antenna, the wireless communication module, and the wireless communication device according to an embodiment of the present disclosure, the mutual coupling between the antenna elements can be reduced.

In the present disclosure, a "dielectric material" may include either a ceramic material or a resin material as a composition. The ceramic material includes an aluminum oxide sintered body, an aluminum nitride sintered body, a mullite sintered body, a glass ceramic sintered body, a crystallized glass obtained by precipitating a crystal component in a glass base material, and microcrystalline sintered body such as mica or aluminum titanate. The resin material includes a material obtained by curing an uncured material such as an epoxy resin, a polyester resin, a polyimide resin, a polyamide-imide resin, a polyetherimide resin, and a liquid crystal polymer.

In the present disclosure, a "conductive material" can include, as a composition, any of a metallic material, a metallic alloy, a cured material of metallic paste, and a conductive polymer. The metallic material includes copper, silver, palladium, gold, platinum, aluminum, chromium, nickel, cadmium, lead, selenium, manganese, tin, vanadium, lithium, cobalt, titanium, and the like. The alloy includes a plurality of metallic materials. The metallic paste includes a paste formed by kneading the powder of a metallic material along with an organic solvent and a binder. The binder includes an epoxy resin, a polyester resin, a polyimide resin, a polyamide-imide resin, and a polyetherimide resin. The conductive polymer includes a polythiophene-based polymer, a polyacetylene-based polymer, a polyaniline-based polymer, a polypyrrole-based polymer, and the like.

Hereinafter, a plurality of embodiments of the present disclosure will be described with reference to the drawings. In the components illustrated in FIGS. 1 to 12, the same components are designated by the same reference numerals.

In the embodiments of the present disclosure, a plane on which a first antenna element 31 and a second antenna element 32 illustrated in FIG. 1 extend is represented as an XY plane. A direction from a first ground conductor 61 illustrated in FIG. 2 toward a first radiation conductor 41 illustrated in FIG. 1 is represented as a positive direction of a Z axis. The opposite direction is represented as a negative direction of the Z axis. In the embodiments of the present disclosure, when a positive direction of an X axis and a negative direction of the X axis are not particularly distinguished, the positive direction of the X axis and the negative direction of the X axis are collectively referred to as "X direction". When a positive direction of a Y axis and a negative direction of the Y axis are not particularly distinguished, the positive direction of the Y axis and the negative direction of the Y axis are collectively referred to as "Y direction". When the positive direction of the Z axis and the negative direction of the Z axis are not particularly distinguished, the positive direction of the Z axis and the negative direction of the Z axis are collectively referred to as "Z direction".

In the embodiments of the present disclosure, a first direction is an X direction. A second direction is a Y direction. However, the first direction and the second direction do not have to be orthogonal to each other. The first direction and the second direction may intersect.

Figure 2:
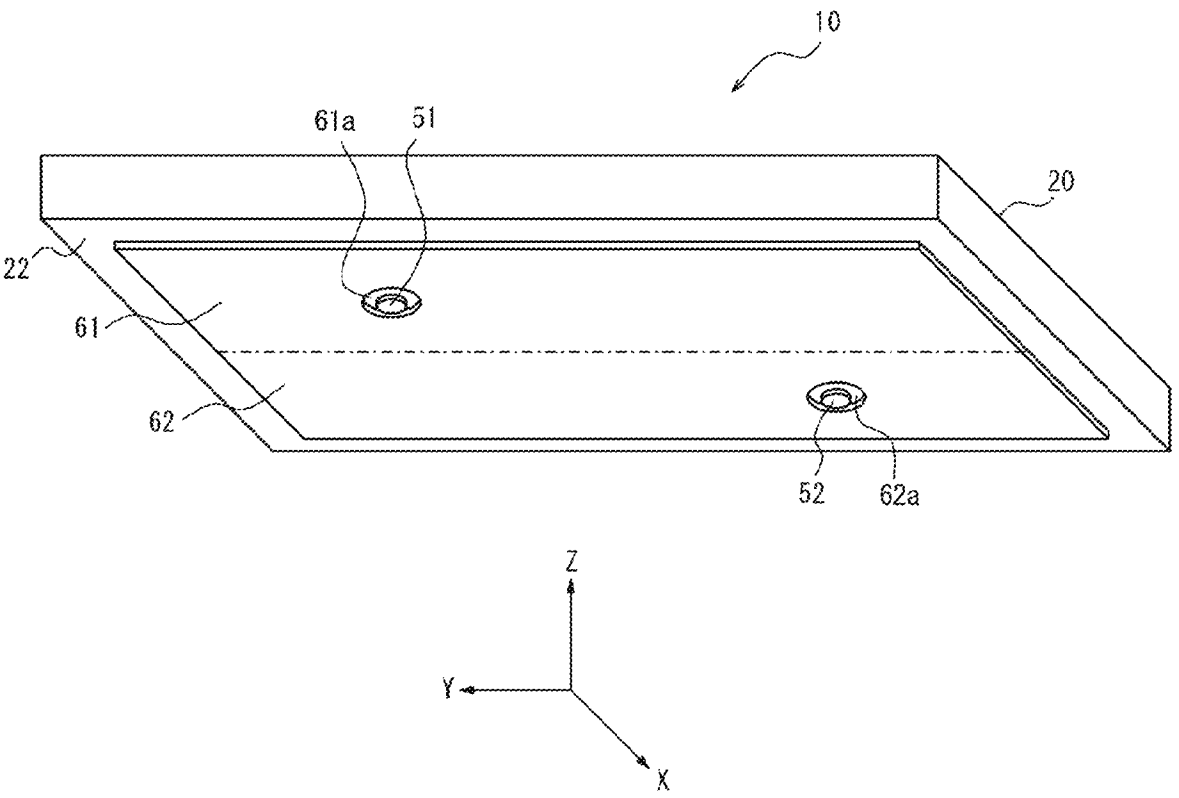
FIG. 2 is a perspective view of the antenna illustrated in FIG. 1 as viewed from a negative direction side of a Z axis.
Figure 3:
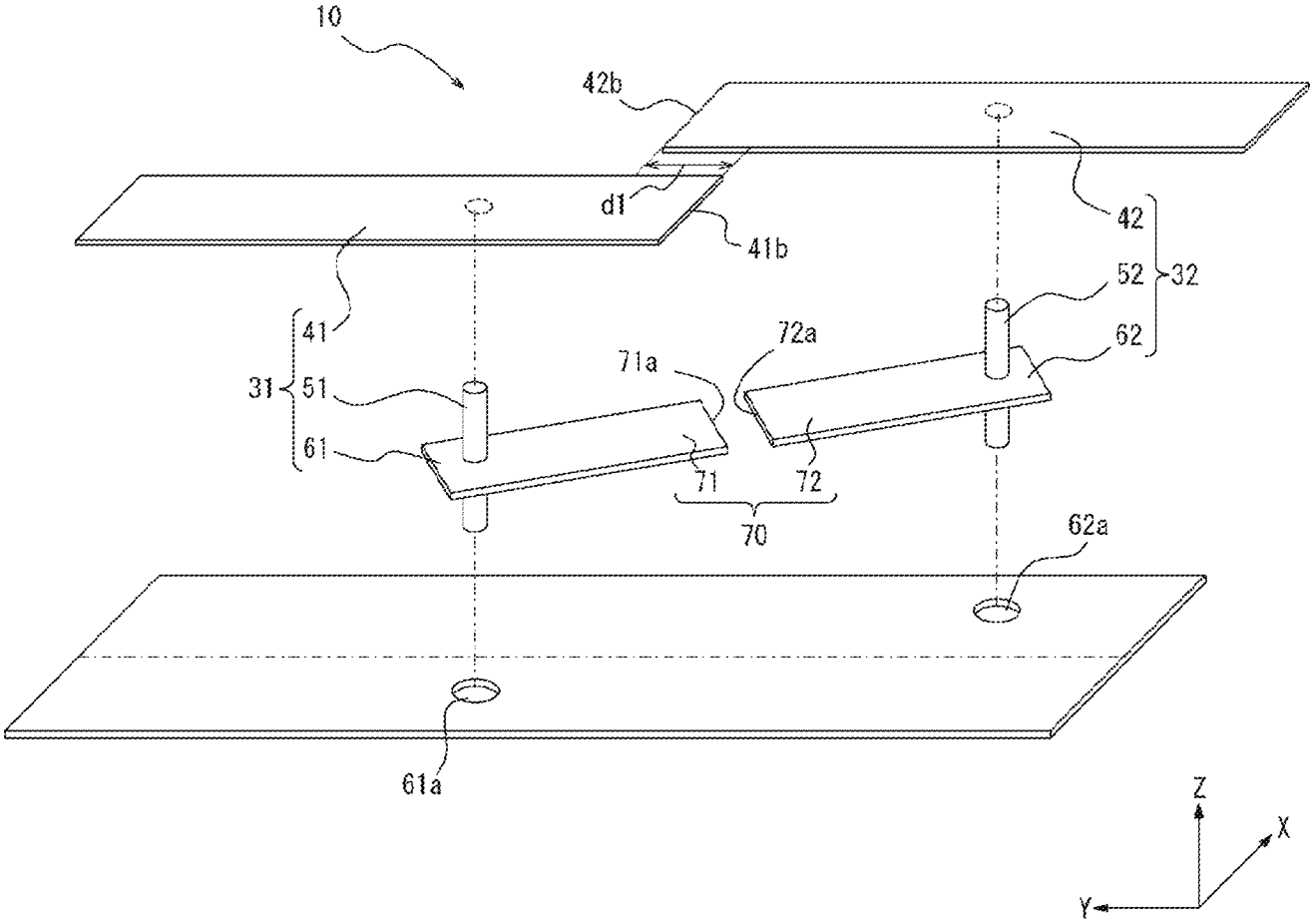
FIG. 3 is an exploded perspective view of a portion of the antenna illustrated in FIG. 1.

FIG. 1 is a perspective view of an antenna 10 according to an embodiment. FIG. 2 is a perspective view of the antenna 10 illustrated in FIG. 1 as viewed from the negative direction side of the Z axis. FIG. 3 is an exploded perspective view of a portion of the antenna 10 illustrated in FIG. 1.

As illustrated in FIG. 1, the antenna 10 has a base 20, a first antenna element 31, a second antenna element 32, and a first coupler 70.

The base 20 is configured to support the first antenna element 31 and the second antenna element 32. The base 20 is a quadrangular prism as illustrated in FIGS. 1 and 2. However, the base 20 may have any shape as long as it can support the first antenna element 31 and the second antenna element 32.

The base 20 may include a dielectric material. A relative permittivity of the base 20 may be appropriately adjusted according to a desired resonance frequency of the antenna 10. The base 20 includes an upper surface 21 and a lower surface 22 as illustrated in FIGS. 1 and 2.

The first antenna element 31 is configured to resonate in a first frequency band. The second antenna element 32 is configured to resonate in a second frequency band. The first frequency band and the second frequency band may belong to the same frequency band or different frequency bands, depending on the use of the antenna 10 and the like. The first antenna element 31 can resonate in the same frequency band as the second antenna element 32. The first antenna element 31 can resonate in a frequency band different from that of the second antenna element 32.

The first antenna element 31 may be configured to resonate in the same phase as the second antenna element 32. A first feeder line 51 and a second feeder line 52 may be configured to feed signals that excite the first antenna element 31 and the second antenna element 32 in the same phase. When the first antenna element 31 and the second antenna element 32 are excited in the same phase, the signal fed from the first feeder line 51 to the first antenna element 31 may have the same phase as the signal fed from the second feeder line 52 to the second antenna element 32. When the first antenna element 31 and the second antenna element 32 are excited in the same phase, the signal fed from the first feeder line 51 to the first antenna element 31 may have a different phase from the signal fed from the second feeder line 52 to the second antenna element 32.

The first antenna element 31 may be configured to resonate in a phase different from that of the second antenna element 32. The first feeder line 51 and the second feeder line 52 may be configured to feed signals that excite the first antenna element 31 and the second antenna element 32 in different phases. When the first antenna element 31 and the second antenna element 32 are excited in different phases, the signal fed from the first feeder line 51 to the first antenna element 31 may have the same phase as the signal fed from the second feeder line 52 to the second antenna element 32. When the first antenna element 31 and the second antenna element 32 are excited in different phases, the signal fed from the first feeder line 51 to the first antenna element 31 may have a different phase from the signal fed from the second feeder line 52 to the second antenna element 32.

As illustrated in FIG. 3, the first antenna element 31 includes a first radiation conductor 41 and the first feeder line 51. The first antenna element 31 may further include a first ground conductor 61. The first antenna element 31 serves as a microstrip type antenna by including the first ground conductor 61. As illustrated in FIG. 3, the second antenna element 32 includes a second radiation conductor 42 and the second feeder line 52. The second antenna element 32 may further include a second ground conductor 62. The second antenna element 32 serves as a microstrip type antenna by including the second ground conductor 62.

The first radiation conductor 41 illustrated in FIG. 1 is configured to radiate power supplied from the first feeder line 51 as electromagnetic waves. The first radiation conductor 41 is configured to supply electromagnetic waves from the outside as power to the first feeder line 51. The second radiation conductor 42 illustrated in FIG. 1 is configured to radiate power supplied from the second feeder line 52 as electromagnetic waves. The second radiation conductor 42 is configured to supply electromagnetic waves from the outside as power to the second feeder line 52.

Each of the first radiation conductor 41 and the second radiation conductor 42 may include a conductive material. Each of the first radiation conductor 41, the second radiation conductor 42, the first feeder line 51, the second feeder line 52, the first ground conductor 61, the second ground conductor 62, and the first coupler 70 may include the same conductive material, or may include different conductive materials.

The first radiation conductor 41 and the second radiation conductor 42 may have a flat plate shape as illustrated in FIG. 1. The first radiation conductor 41 and the second radiation conductor 42 can extend along the XY plane. The first radiation conductor 41 and the second radiation conductor 42 are located on the upper surface 21 of the base 20. The first radiation conductor 41 and the second radiation conductor 42 may be located partially in the base 20.

In the present embodiment, the first radiation conductor 41 and the second radiation conductor 42 have the same rectangular shape. However, the first radiation conductor 41 and the second radiation conductor 42 may have any shape. In addition, the first radiation conductor 41 and the second radiation conductor 42 may have different shapes.

A longitudinal direction of the first radiation conductor 41 and the second radiation conductor 42 is along the Y direction. A lateral direction of the first radiation conductor 41 and the second radiation conductor 42 is along the X direction. The first radiation conductor 41 includes a long side 41*a* and a short side 41*b*. The second radiation conductor 42 includes a long side 42*a* and a short side 42*b*.

The first radiation conductor 41 and the second radiation conductor 42 are arranged to be shifted in the long side direction, that is, in the Y direction. By arranging the first radiation conductor 41 and the second radiation conductor 42 so as to be shifted in the Y direction, a portion of the long side 41*a* and a portion of the long side 42*a* face each other. A gap g1 is generated when a portion of the long side 41*a* and a portion of the long side 42*a* face each other.

The first radiation conductor 41 and the second radiation conductor 42 are arranged at an interval of equal to or less than ½ of the resonance wavelength of the antenna 10. In the present embodiment, as illustrated in FIG. 1, the first radiation conductor 41 and the second radiation conductor 42 are arranged so that a gap g1 between the long side 41*a* and the long side 42*a* facing each other is equal to or less than ½ of the resonance wavelength of the antenna 10.

A current can flow through the first radiation conductor 41 along the Y direction. When the current flows through the first radiation conductor 41 along the Y direction, a magnetic field surrounding the first radiation conductor 41 changes in the XZ plane. A current can flow through the second radiation conductor 42 along the Y direction. When the current flows through the second radiation conductor 42 along the Y direction, a magnetic field surrounding the second radiation conductor 42 changes in the XZ plane. The magnetic field surrounding the first radiation conductor 41 and the magnetic field surrounding the second radiation conductor 42 interact with each other. For example, when the first radiation conductor 41 and the second radiation conductor 42 are excited in the same phase or phases close to each other, most of the currents flowing through the first radiation conductor 41 and the second radiation conductor 42 flow in the same direction. Examples of the phases close to each other include cases where both phases are within ±60°, within ±45°, and within ±30°.

When most of the currents flowing through the first radiation conductor 41 and the second radiation conductor 42 are in the same direction, magnetic field coupling between the first radiation conductor 41 and the second radiation conductor 42 can be large. The first radiation conductor 41 and the second radiation conductor 42 can be configured so that the magnetic field coupling becomes large by flowing most of the flowing currents in the same direction. In the present embodiment, a magnitude of the magnetic field coupling between the first radiation conductor 41 and the second radiation conductor 42 depends on a length of the gap g1 in the Y direction. The length of the gap g1 in the Y direction corresponds to an interval dl illustrated in FIG. 3. The interval dl is also referred to as an "amount of shift" in the Y direction between the first radiation conductor 41 and the second radiation conductor 42. The magnitude of the magnetic field coupling between the first radiation conductor 41 and the second radiation conductor 42 can be smaller as the interval dl is smaller.

When most of the currents flowing through the first radiation conductor 41 and the second radiation conductor 42 flow in an inverse direction, capacitive coupling between the first radiation conductor 41 and the second radiation conductor 42 can be large. The electric field is large at both ends of the first radiation conductor 41 and both ends of the second radiation conductor 42. The electric field is large at the short side 41*b* of the first radiation conductor 41 and the short side 42*b* of the second radiation conductor 42. In the present embodiment, the magnitude of the capacitive coupling between the first radiation conductor 41 and the second radiation conductor 42 depends on the interval dl between the short side 41*b* and the short side 42*b*. The magnitude of the capacitive coupling between the first radiation conductor 41 and the second radiation conductor 42 can be larger as the interval dl is smaller.

When the resonance frequencies of the first radiation conductor 41 and the second radiation conductor 42 are the same or close to each other, the first radiation conductor 41 and the second radiation conductor 42 may be configured so that a coupling occurs at the time of resonance. The coupling at the time of resonance can be referred to as "even mode" and "odd mode". The even mode and the odd mode are also collectively referred to as the "even-odd mode". When the first radiation conductor 41 and the second radiation conductor 42 resonate in the even-odd mode, each of the first radiation conductor 41 and the second radiation conductor 42 resonates at a resonance frequency different from the case where they do not resonate in the even-odd mode. In many cases in which the first radiation conductor 41 and the second radiation conductor 42 are coupled, magnetic field coupling and electric field coupling occur at the same time. If one of the magnetic field coupling and the electric field coupling becomes dominant, the coupling between the first radiation conductor 41 and the second radiation conductor can finally be regarded as the dominant one of the magnetic field coupling or the electric field coupling. In the present embodiment, by appropriately adjusting the interval dl, it is possible to reduce that one of the magnetic field coupling and the electric field coupling becomes dominant in the coupling between the first radiation conductor 41 and the second radiation conductor.

The first feeder line 51 illustrated in FIG. 3 is configured to be electrically connected to the first radiation conductor 41. The first feeder line 51 is configured to be coupled to the first radiation conductor 41 such that the inductance component is dominant. However, the first feeder line 51 may be configured to be magnetically connected to the first radiation conductor 41. When the first feeder line 51 is configured to be magnetically connected to the first radiation conductor 41, the first feeder line 51 may be configured to be coupled to the first radiation conductor 41 such that the capacitance component is dominant. The first feeder line 51 may extend from an opening 61*a* of the first ground conductor 61 illustrated in FIG. 2 to an external device or the like.

The second feeder line 52 illustrated in FIG. 3 is configured to be electrically connected to the second radiation conductor 42. The second feeder line 52 is configured to be coupled to the second radiation conductor 42 such that the inductance component is dominant. However, the second feeder line 52 may be configured to be magnetically connected to the second radiation conductor 42. When the second feeder line 52 is configured to be magnetically connected to the second radiation conductor 42, the second feeder line 52 may be configured to be coupled to the second radiation conductor 42 such that the capacitance component is dominant. The second feeder line 52 can extend from an opening 62*a* of the second ground conductor 62 illustrated in FIG. 2 to an external device or the like.

The first feeder line 51 is configured to supply power to the first radiation conductor 41. The first feeder line 51 is configured to supply the power from the first radiation conductor 41 to an external device or the like. The second feeder line 52 is configured to supply power to the second radiation conductor 42. The second feeder line 52 is configured to supply the power from the second radiation conductor 42 to an external device or the like.

The first feeder line 51 and the second feeder line 52 may include a conductive material. Each of the first feeder line 51 and the second feeder line 52 may be a through-hole conductor, a via conductor, or the like. The first feeder line 51 and the second feeder line 52 may be located in the base 20. As illustrated in FIG. 3, the first feeder line 51 penetrates through a first conductor 71 of the first coupler 70. As illustrated in FIG. 3, the second feeder line 52 penetrates through a second conductor 72 of the first coupler 70.

As illustrated in FIG. 3, the first feeder line 51 extends in the Z direction in the base 20. The first feeder line 51 is configured so that a current flows along the Z direction. When the current flows through the first feeder line 51 along the Z direction, the magnetic field surrounding the first feeder line 51 changes in the XY plane.

As illustrated in FIG. 3, the second feeder line 52 extends in the Z direction in the base 20. The second feeder line 52 is configured so that a current flows along the Z direction. When the current flows through the second feeder line 52 along the Z direction, the magnetic field surrounding the second feeder line 52 changes in the XY plane.

The magnetic field surrounding the first feeder line 51 and the magnetic field surrounding the second feeder line 52 can interfere with each other. For example, when most of the currents flowing through the first feeder line 51 and the second feeder line 52 flow in the same direction, the magnetic field surrounding the first feeder line 51 and the magnetic field surrounding the second feeder line 52 constructively interfere with each other in a macroscopic manner. The first feeder line 51 and the second feeder line 52 can be magnetically coupled by interference between the magnetic field surrounding the first feeder line 51 and the magnetic field surrounding the second feeder line 52.

The second feeder line 52 is configured to be coupled to the first feeder line 51 such that a first component is dominant. The first component is one of the capacitance component and the inductance component. The first feeder line 51 and the second feeder line 52 can be magnetically coupled by interference between the magnetic field surrounding the first feeder line 51 and the magnetic field surrounding the second feeder line 52. The second feeder line 52 is configured to be coupled to the first feeder line 51 such that the inductance component serving as the first component is dominant.

The first ground conductor 61 illustrated in FIG. 2 is configured to provide a reference potential in the first antenna element 31. The second ground conductor 62 illustrated in FIG. 2 is configured to provide a reference potential in the second antenna element 32. Each of the first ground conductor 61 and the second ground conductor 62 may be configured to be electrically connected to a ground of the device including the antenna 10.

The first ground conductor 61 and the second ground conductor 62 may include a conductive material. The first ground conductor 61 and the second ground conductor 62 may have a flat plate shape. The first ground conductor 61 and the second ground conductor 62 are located on the lower surface 22 of the base 20. The first ground conductor 61 and the second ground conductor 62 may be located partially in the base 20.

The first ground conductor 61 may be connected to the second ground conductor 62. For example, the first ground conductor 61 may be configured to be electrically connected to the second ground conductor 62. The first ground conductor 61 and the second ground conductor 62 may be formed integrally as illustrated in FIG. 2. The first ground conductor 61 and the second ground conductor 62 may be integrated with a single base 20. However, the first ground conductor 61 and the second ground conductor 62 may be independent and separate members. When the first ground conductor 61 and the second ground conductor 62 are independent and separate members, each of the first ground conductor 61 and the second ground conductor 62 can be integrated with the base 20 separately.

The first ground conductor 61 and the second ground conductor 62 extend along the XY plane, as illustrated in FIG. 2. Each of the first ground conductor 61 and the second ground conductor 62 is separated from each of the first radiation conductor 41 and the second radiation conductor 42 in the Z direction. The base 20 is interposed between the first ground conductor 61 and the second ground conductor 62 and the first radiation conductor 41 and the second radiation conductor 42. The first ground conductor 61 faces the first radiation conductor 41 in the Z direction. The second ground conductor 62 faces the second radiation conductor 42 in the Z direction. The first ground conductor 61 and the second ground conductor 62 have a rectangular shape according to the first radiation conductor 41 and the second radiation conductor 42. However, the first ground conductor 61 and the second ground conductor 62 may have any shape according to the first radiation conductor 41 and the second radiation conductor 42.

The first coupler 70 is configured to couple the first feeder line 51 and the second feeder line 52 such that a second component different from the first component is dominant. When the first component is an inductance component, the second component is a capacitance component. The first coupler 70 is configured to couple the first feeder line 51 and the second feeder line 52 such that the capacitance component serving as the second component is dominant.

For example, the first coupler 70 includes the first conductor 71 and the second conductor 72, as illustrated in FIG. 3. Each of the first conductor 71 and the second conductor 72 may include a conductive material. Each of the first conductor 71 and the second conductor 72 extends along the XY plane. Each of the first conductor 71 and the second conductor 72 has a flat plate shape as illustrated in FIG. 3. The first conductor 71 is configured to be electrically connected to the first feeder line 51 penetrating through the first conductor 71. The second conductor 72 is configured to be electrically connected to the second feeder line 52 penetrating through the second conductor 72. As illustrated in FIG. 3, an end portion 71*a* of the first conductor 71 and an end portion 72*a* of the second conductor 72 face each other. The end portion 71*a* of the first conductor 71 and the end portion 72*a* of the second conductor 72 can configure a capacitor via the base 20. By configuring the capacitor, the first coupler 70 is configured to couple the first feeder line 51 and the second feeder line 52 such that the capacitance component serving as the second component is dominant.

When the first feeder line 51 directly feeds power to the first radiation conductor 41 and the second feeder line 52 directly feeds power to the second radiation conductor 42, in the coupling between the first feeder line 51 and the second feeder line 52, the inductance component may be dominant. The inductance component in the coupling between the first feeder line 51 and the second feeder line 52 forms a parallel circuit with the capacitance component due to the first coupler 70. In the antenna 10, an anti-resonance circuit including the inductance component and the capacitance component is configured. The anti-resonance circuit can cause an attenuation pole in transmission characteristics between the first antenna element 31 and the second antenna element 32. The transmission characteristics are characteristics of power transmitted from the first feeder line 51, which is an input port of the first antenna element 31, to the second feeder line 52, which is an input port of the second antenna element 32. By causing the attenuation pole in the transmission characteristics, the interference between the first antenna element 31 and the second antenna element 32 can be reduced in the antenna 10.

In this way, the first coupler 70 is configured to couple the first feeder line 51, which is the input port of the first antenna element 31, and the second feeder line 52, which is the input port of the second antenna element 32, such that second component is dominant. The second component is different from the first component, which is dominant in the coupling between the first feeder line 51 itself and the second feeder line 52 itself. The first component and the second component forms a parallel circuit, so that the antenna 10 has an anti-resonance circuit at the input port.

The second feeder line 52 is configured to be coupled to the first feeder line 51 such that the inductance component serving as the first component is dominant. The first coupler 70 is configured to couple the first feeder line 51 and the second feeder line 52 such that the capacitance component serving as the second component is dominant. A coupling coefficient $K_1$ due to the capacitance component and the inductance component between the first feeder line 51 and the second feeder line 52 can be calculated by using a coupling coefficient $Ke_1$ and a coupling coefficient $Km_1$. The coupling coefficient $Ke_1$ is a coupling coefficient due to the capacitance component between the first feeder line 51 and the second feeder line 52. The coupling coefficient $Km_1$ is a coupling coefficient due to an inductance component between the first feeder line 51 and the second feeder line 52. For example, the relationship between the coupling coefficient $K_1$ and the coupling coefficients $Ke_1$ and $Km_1$ is expressed by Equation: $K_1=(Ke_1^2-Km_1^2)/(Ke_1^2+Km_1^2)$.

The coupling coefficient $Km_1$ can be determined according to the configuration of the first feeder line 51 and the second feeder line 52. For example, the coupling coefficient $Km_1$ can change in response to a change in a length of the gap between the first feeder line 51 and the second feeder line 52 illustrated in FIG. 3. In the antenna 10, the magnitude of the coupling coefficient $Ke_1$ can be adjusted by appropriately configuring the first coupler 70. In the antenna 10, by adjusting the magnitude of the coupling coefficient $Ke_1$ according to the coupling coefficient $Km_1$, the degree to which the coupling coefficient $Km_1$ and the coupling coefficient $Ke_1$ cancel each other can be changed. In the antenna 10, with the coupling coefficient $Ke_1$ having a magnitude corresponding to the coupling coefficient $Km_1$, the coupling coefficient $Km_1$ and the coupling coefficient $Ke_1$ cancel each other, and the coupling coefficient $K_1$ can be reduced. By reducing the coupling coefficient $K_1$, in the antenna 10, the mutual coupling between the first feeder line 51 and the second feeder line 52 can be reduced. By reducing the mutual coupling between the first feeder line 51 and the second feeder line 52, each of the first antenna element 31 and the second antenna element 32 can efficiently radiate electromagnetic waves by the power from each of the first feeder line 51 and the second feeder line 52.

The first radiation conductor 41 and the second radiation conductor 42 are arranged to be shifted in the Y direction. The smaller the interval dl illustrated in FIG. 3, the smaller the magnitude of the magnetic field coupling between the first radiation conductor 41 and the second radiation conductor 42. The smaller the interval dl illustrated in FIG. 3, the larger the magnitude of the capacitive coupling between the first radiation conductor 41 and the second radiation conductor 42. A coupling coefficient $K_2$ due to the capacitive coupling and the magnetic field coupling between the first radiation conductor 41 and the second radiation conductor 42 can be calculated by using a coupling coefficient $Ke_2$ and a coupling coefficient $Km_2$. The coupling coefficient $Ke_2$ is a coupling coefficient of the capacitive coupling between the first radiation conductor 41 and the second radiation conductor 42. The coupling coefficient $Km_2$ is a coupling coefficient of the magnetic field coupling between the first radiation conductor 41 and the second radiation conductor 42. For example, the coupling coefficient $K_2$ is expressed by Equation: $K_2=(Ke_2^2-Km_2^2)/(Ke_2^2+Km_2^2)$.

The coupling coefficient $K_2$ can be reduced by canceling the coupling coefficient $Km_2$ and the coupling coefficient $Ke_2$ each other. In the antenna 10, the amount of shift between the first radiation conductor 41 and the second radiation conductor 42, that is, the degree to which the coupling coefficient $Km_2$ and the coupling coefficient $Ke_2$ cancel each other can be changed by appropriately adjusting the interval dl. In the antenna 10, by adjusting the interval dl as appropriate, the coupling coefficient $Km_2$ and the coupling coefficient $Ke_2$ can cancel each other, and the coupling coefficient $K_2$ can be reduced. By reducing the coupling coefficient $K_2$, each of the first antenna element 31 and the second antenna element 32 can efficiently radiate electromagnetic waves by each of the first radiation conductor 41 and the second radiation conductor 42.

Figure 4:
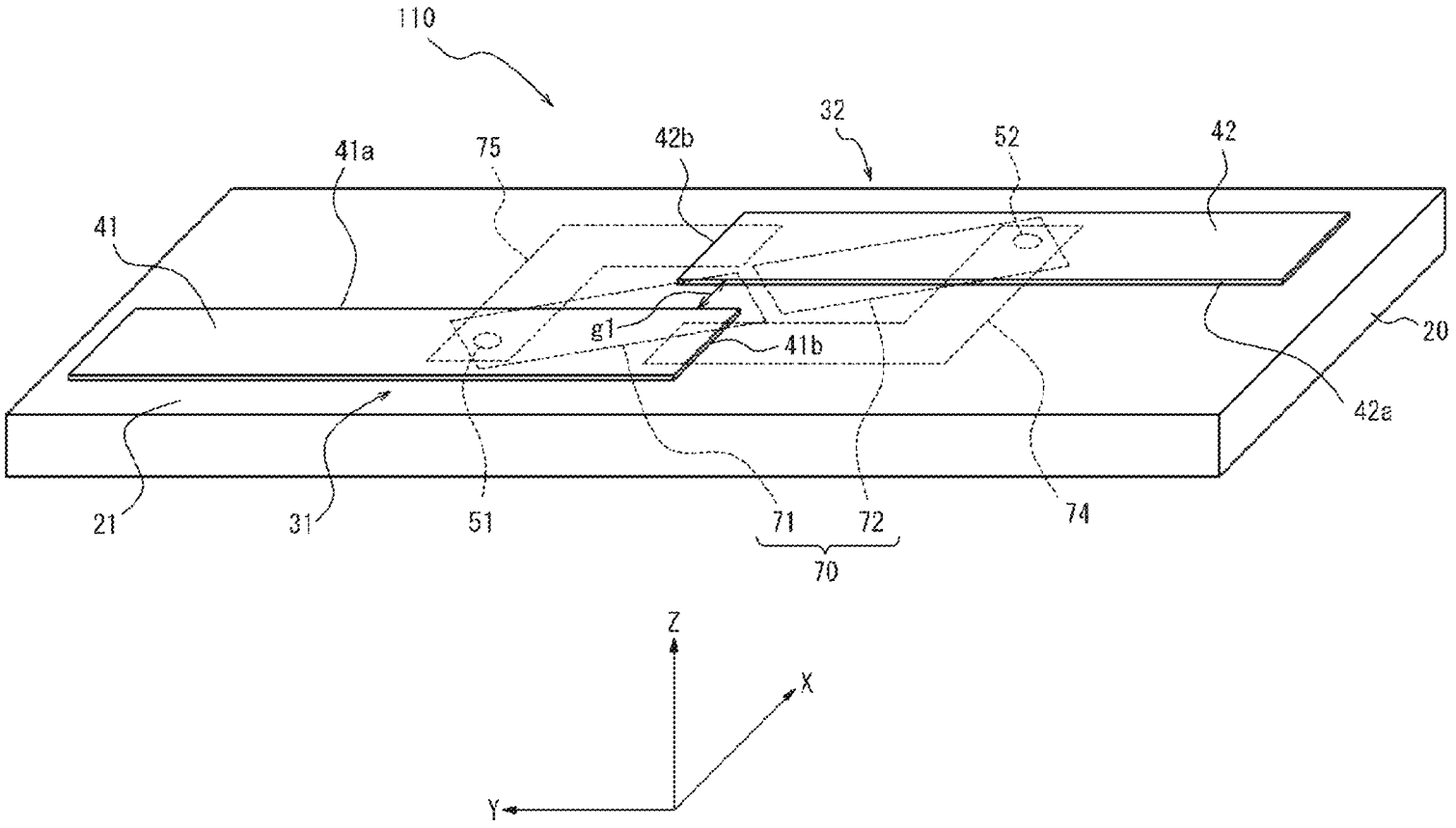
FIG. 4 is a perspective view of an antenna according to an embodiment.
Figure 5:
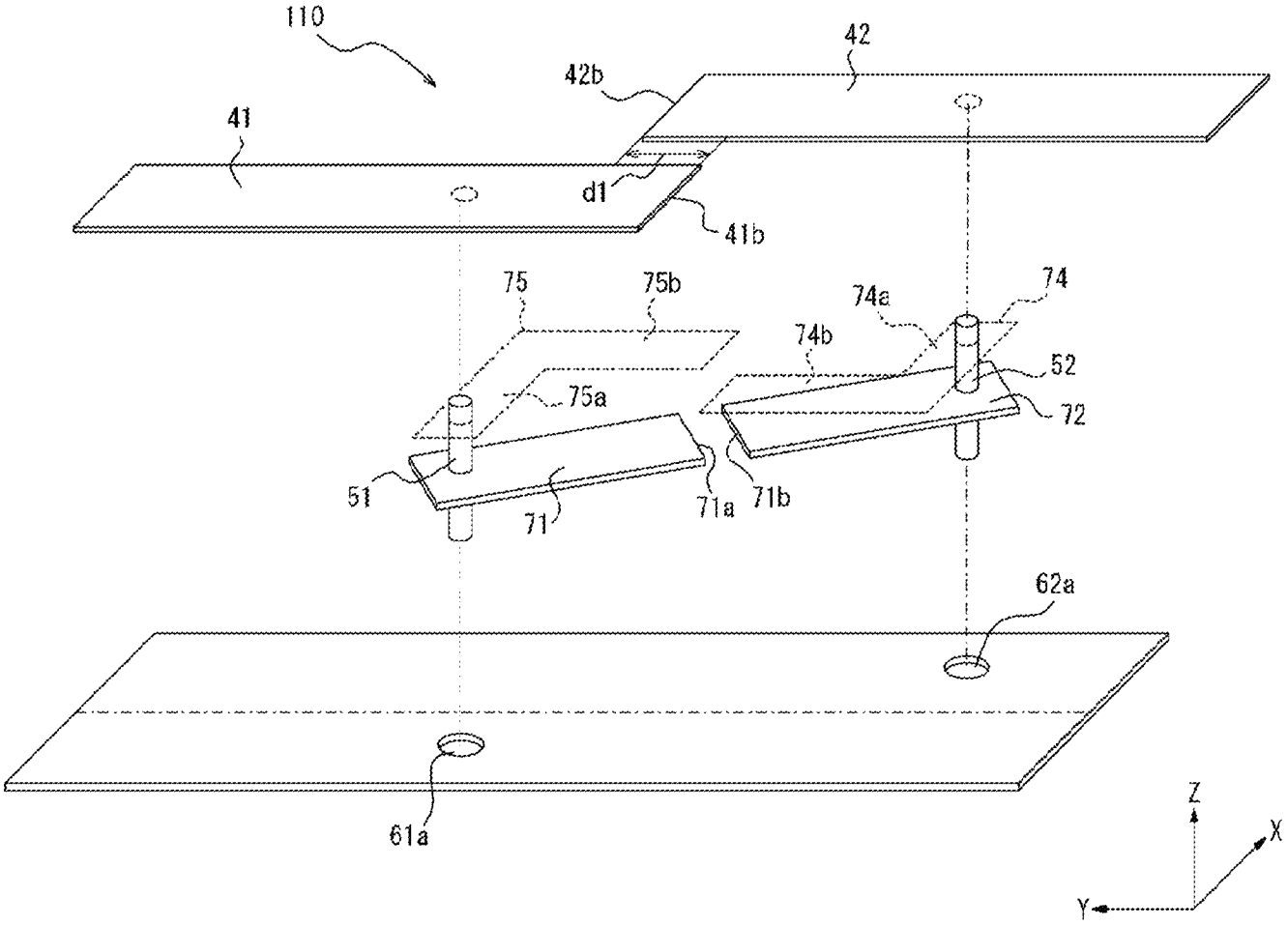
FIG. 5 is an exploded perspective view of a portion of the antenna illustrated in FIG. 4.

FIG. 4 is a perspective view of an antenna 110 according to an embodiment. FIG. 5 is an exploded perspective view of a portion of the antenna 110 illustrated in FIG. 4.

As illustrated in FIG. 4, the antenna 110 includes the base 20, the first antenna element 31, the second antenna element 32, the first coupler 70, and a first coupling portion 74. The antenna 110 may further include a second coupling portion 75.

The first coupling portion 74 is configured to couple the first radiation conductor 41 and the second feeder line 52. The first coupling portion 74 may be configured to couple the first radiation conductor 41 and the second feeder line 52 such that one of the capacitance component and the inductance component is dominant, depending on the configuration of the first radiation conductor 41 and the second feeder line 52. In the present embodiment, the first coupling portion 74 is configured to couple the first radiation conductor 41 and the second feeder line 52 such that the capacitance component serving as the second component is dominant.

For example, the first coupling portion 74 may include a conductive material. The first coupling portion 74 is located in the base 20. The first coupling portion 74 is located to be separated from each of the first radiation conductor 41 and the second radiation conductor 42 in the Z direction. The first coupling portion 74 may be L-shaped, as illustrated in FIG. 5. The L-shaped first coupling portion 74 includes a piece **74*a* and a piece 74*b*. As illustrated in FIG. 5, the second feeder line 52 penetrates through the piece 74*a*. The piece 74*a* is configured to be electrically connected to the second feeder line 52 by penetrating through the second feeder line 52. As illustrated in FIG. 5, the piece 74***b* overlaps a portion of the first radiation conductor 41 in the XY plane by extending from an end portion of the piece 74*a* on a negative direction side of an X axis toward a negative direction of a Y axis. The first coupling portion 74 is configured to be capacitively coupled to the first radiation conductor 41 by overlapping the piece 74*b* with a portion of the first radiation conductor 41 in the XY plane. The first coupling portion 74 is configured to couple the first radiation conductor 41 and the second feeder line 52 such that the capacitance component serving as the second component is dominant, by electrically connecting the piece 74*a* with the second feeder line 52 and capacitively connecting the piece 74*b* with the first radiation conductor 41.

A coupling coefficient $K_3$ due to the capacitance component and the inductance component between the first radiation conductor 41 and the second feeder line 52 can be reduced by canceling a coupling coefficient $Ke_3$ and a coupling coefficient $Km_3$ each other. The coupling coefficient $Ke_3$ is a coupling coefficient due to the capacitance component between the first radiation conductor 41 and the second feeder line 52. The coupling coefficient $Km_3$ is a coupling coefficient due to the inductance component between the first radiation conductor 41 and the second feeder line 52. Depending on the frequency used in the antenna 110 and the configuration of the antenna 110, the coupling coefficient $Km_3$ may be larger than the coupling coefficient $Ke_3$. In such a configuration, the degree to which the coupling coefficient $Ke_3$ and the coupling coefficient $Km_3$ cancel each other can be changed by appropriately configuring the first coupling portion 74. By appropriately configuring the first coupling portion 74, the coupling coefficient $Ke_3$ and the coupling coefficient $Km_3$ can cancel each other, and the coupling coefficient $K_3$ can be reduced. By reducing the coupling coefficient $K_3$, the mutual coupling between the first radiation conductor 41 and the second feeder line 52 can become smaller.

The second coupling portion 75 is configured to couple the second radiation conductor 42 and the first feeder line 51. The second coupling portion 75 may be configured to couple the second radiation conductor 42 and the first feeder line 51 such that one of the capacitance component and the inductance component is dominant, depending on the configuration of the second radiation conductor 42 and the first feeder line 51. In the present embodiment, the second coupling portion 75 is configured to couple the second radiation conductor 42 and the first feeder line 51 such that the capacitance component serving as the second component is dominant.

For example, the second coupling portion 75 may include a conductive material. The second coupling portion 75 is located in the base 20. The second coupling portion 75 is located to be separated from each of the first radiation conductor 41 and the second radiation conductor 42 in the Z direction. The second coupling portion 75 may be L-shaped, as illustrated in FIG. 5. The L-shaped second coupling portion 75 includes a piece 75*a* and a piece 75*b*. In the second coupling portion 75, the piece 75*a* is electrically connected to the first feeder line 51, and the piece 75*b* is capacitively coupled to the second radiation conductor 42. With such a configuration, the second coupling portion 75 is configured to couple the second radiation conductor 42 and the first feeder line 51 such that the capacitance component serving as the second component is dominant, in the same as or similar to the first coupling portion 74.

A coupling coefficient $K_4$ due to the capacitance component and the inductance component between the second radiation conductor 42 and the first feeder line 51 can be reduced by canceling a coupling coefficient $Ke_4$ and a coupling coefficient $Km_4$ each other. The coupling coefficient $Ke_4$ is a coupling coefficient due to the capacitance component between the second radiation conductor 42 and the first feeder line 51. The coupling coefficient $Km_4$ is a coupling coefficient due to the inductance component between the second radiation conductor 42 and the first feeder line 51. Depending on the frequency used in the antenna 110 and the configuration of the antenna 110, the coupling coefficient $Km_4$ may be larger than the coupling coefficient $Ke_4$. In such a configuration, the degree to which the coupling coefficient $Ke_4$ and the coupling coefficient $Km_4$ cancel each other can be changed by appropriately configuring the second coupling portion 75. By appropriately configuring the second coupling portion 75, the coupling coefficient $Ke_4$ and the coupling coefficient $Km_4$ can cancel each other, and the coupling coefficient $K_4$ can be reduced. By reducing the coupling coefficient $K_4$, the mutual coupling between the second radiation conductor 42 and the first feeder line 51 can become smaller.

Other configurations and effects of the antenna 110 are the same as or similar to the configurations and effects of the antenna 10 illustrated in FIG. 1.

Figure 6:
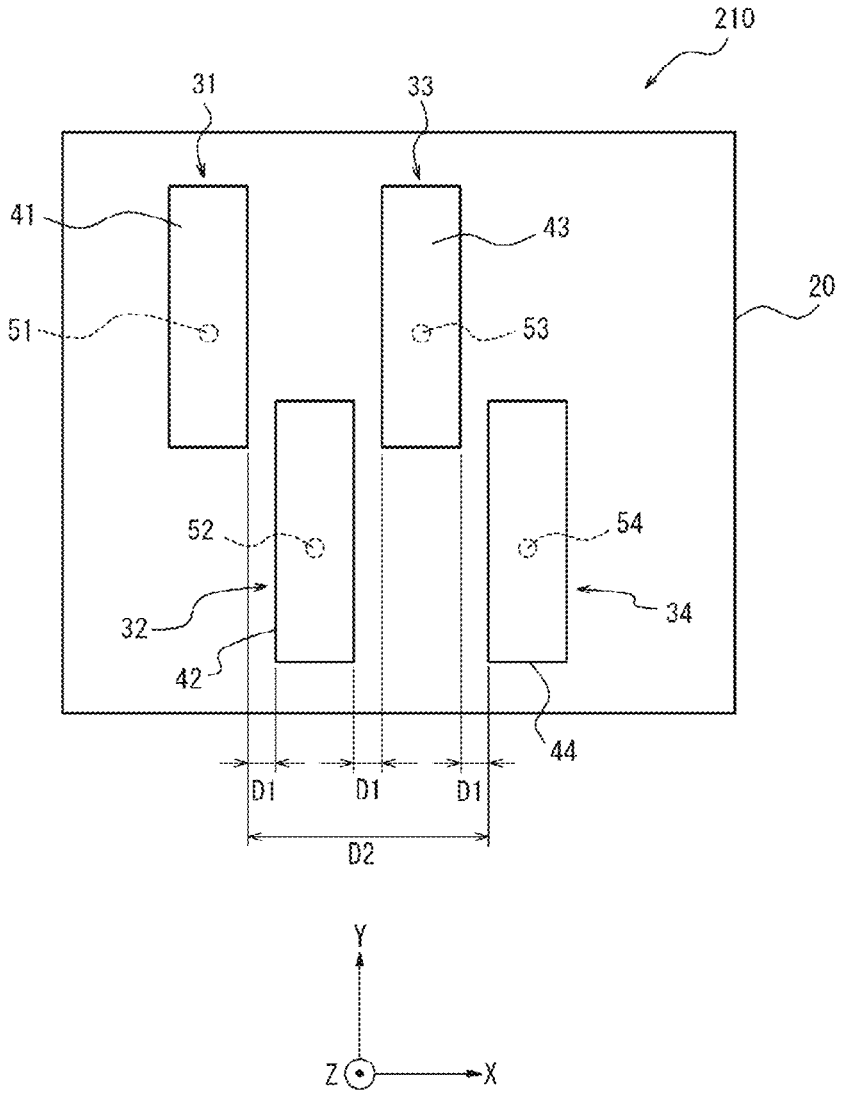
FIG. 6 is a plan view of an antenna according to an embodiment.

FIG. 6 is a plan view of an antenna 210 according to an embodiment. In FIG. 6, a first direction is the X direction. A second direction is the Y direction.

The antenna 210 can be an array antenna. The antenna 210 may be a linear array antenna.

The antenna 210 has the base 20 and n (n: 3 or more integers) antenna elements as a plurality of antenna elements. In the present embodiment, the antenna 210 has four antenna elements (n=4), that is, a first antenna element 31, a second antenna element 32, a third antenna element 33, and a fourth antenna element 34.

The antenna 210 may appropriately have the first coupler 70 illustrated in FIG. 1, and the first coupling portion 74 and the second coupling portion 75 illustrated in FIG. 4, depending on the configuration of the first antenna element 31 and the like.

The third antenna element 33 is configured to resonate in a first frequency band or a second frequency band depending on the use of the antenna 210 and the like. The third antenna element 33 may have the same or similar configuration as the first antenna element 31 or the second antenna element 32 illustrated in FIG. 1. The third antenna element 33 has a third radiation conductor 43 and a third feeder line 53. The third radiation conductor 43 may have the same or similar configuration as the first radiation conductor 41 or the second radiation conductor 42 illustrated in FIG. 1. The third feeder line 53 may have the same or similar configuration as the first feeder line 51 or the second feeder line illustrated in FIG. 3.

The fourth antenna element 34 is configured to resonate in a first frequency band or a second frequency band depending on the use of the antenna 210 and the like. The fourth antenna element 34 may have the same or similar configuration as the first antenna element 31 or the second antenna element 32 illustrated in FIG. 1. The fourth antenna element 34 has a fourth radiation conductor 44 and a fourth feeder line 54. The fourth radiation conductor 44 may have the same or similar configuration as the first radiation conductor 41 or the second radiation conductor 42 illustrated in FIG. 1. The fourth feeder line 54 may have the same or similar configuration as the first feeder line 51 or the second feeder line illustrated in FIG. 3.

The first antenna element 31 to the fourth antenna element 34 may be configured to resonate in the same phase. The first feeder line 51 to the fourth feeder line 54 may be configured to feed signals that excite the first antenna element 31 to the fourth antenna element 34 in the same phase. When exciting the first antenna element 31 to the fourth antenna element 34 in the same phase, the signals fed from the first feeder line 51 to the fourth feeder line 54 to the first antenna element 31 to the fourth antenna element 34 may have the same phase. When exciting the first antenna element 31 to the fourth antenna element 34 in the same phase, the signals fed from the first feeder line 51 to the fourth feeder line 54 to the first antenna element 31 to the fourth antenna element 34 may have different phases.

The first antenna element 31 to the fourth antenna element 34 may be configured to resonate in different phases. The first feeder line 51 to the fourth feeder line 54 may be configured to feed signals that excite the first antenna element 31 to the fourth antenna element 34 in different phases. When exciting the first antenna element 31 to the fourth antenna element 34 in different phases, the signals fed from the first feeder line 51 to the fourth feeder line 54 to the first antenna element 31 to the fourth antenna element 34 may have the same phase. When exciting the first antenna element 31 to the fourth antenna element 34 in different phases, the signals fed from the first feeder line 51 to the fourth feeder line 54 to the first antenna element 31 to the fourth antenna element 34 may have different phases.

The first antenna element 31, the second antenna element 32, the third antenna element 33, and the fourth antenna element 34 are arranged along the X direction. The first antenna element 31, the second antenna element 32, the third antenna element 33, and the fourth antenna element 34 may be arranged at intervals equal to or less than ¼ of the resonance wavelength of the antenna 210 in the X direction. In the present embodiment, the first radiation conductor 41, the second radiation conductor 42, the third radiation conductor 43, and the fourth radiation conductor 44 are arranged along the X direction with an interval D1. The interval D1 is equal to or less than ¼ of the resonance wavelength of the antenna 210.

When the fourth antenna element 34 as an n-th antenna element resonates at the first frequency, the fourth radiation conductor 44 as an n-th radiation conductor may be arranged with the first radiation conductor 41 in the X direction at an interval equal to or less than ½ of the resonance wavelength of the antenna 210. In the present embodiment, the first radiation conductor 41 and the fourth radiation conductor 44 are arranged along the X direction with an interval D2. The interval D2 is equal to or less than ½ of the resonance wavelength of the antenna 210. The fourth radiation conductor 44 may be configured to be directly or indirectly coupled to the second radiation conductor 42.

In the antenna 210, the first antenna element 31 and the second antenna element 32 that are adjacent to each other are arranged to be shifted in the Y direction in the same or similar manner as the configuration illustrated in FIG. 1. The second antenna element 32 and the third antenna element 33 that are adjacent to each other are arranged to be shifted in the Y direction. In the same or similar manner, the third antenna element 33 and the fourth antenna element 34 that are adjacent to each other are arranged to be shifted in the Y direction.

Figure 7:
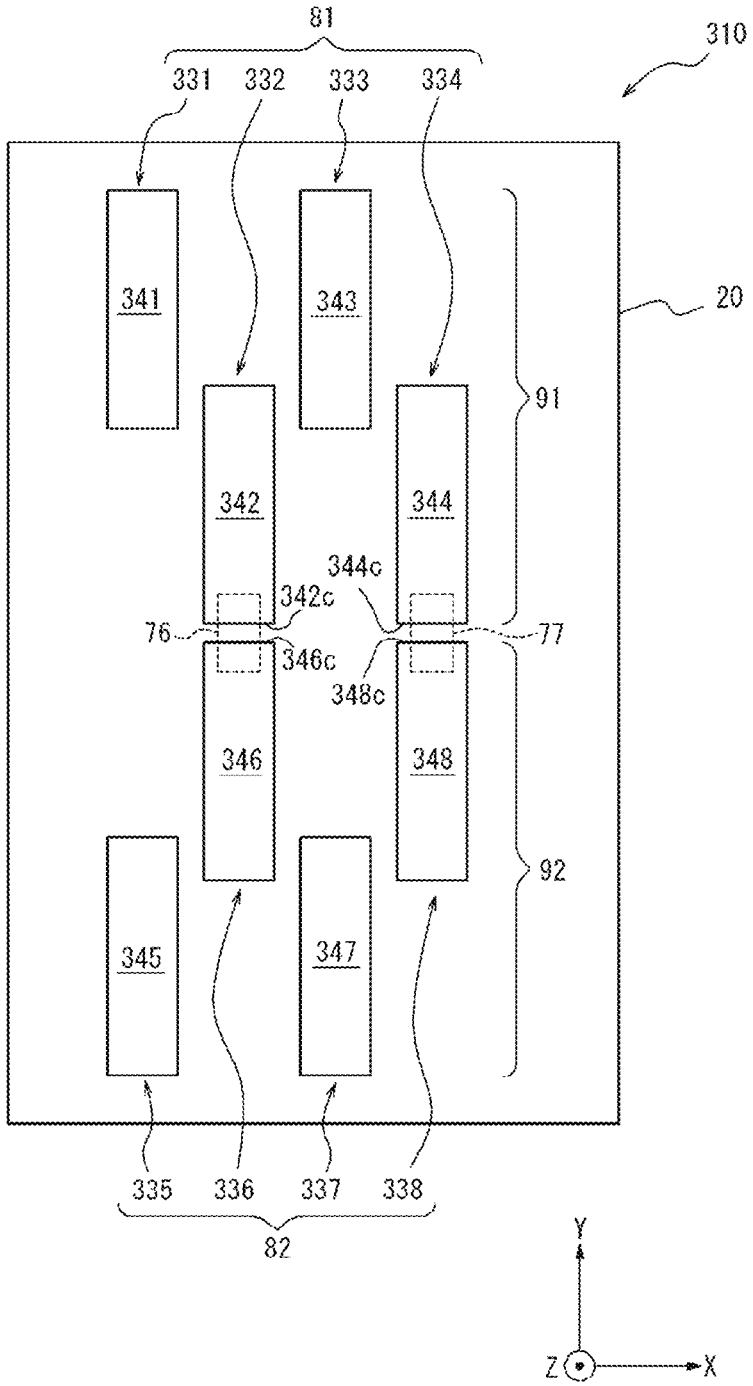
FIG. 7 is a plan view of an antenna according to an embodiment.

FIG. 7 is a plan view of an antenna 310 according to an embodiment. In FIG. 7, a first direction is the X direction. A second direction is the Y direction.

The antenna 310 can be an array antenna. The antenna 310 may be a planar antenna.

The antenna 310 has the base 20, a first antenna element group 81, and a second antenna element group 82. The antenna 310 may further include second couplers 76 and 77. The antenna 310 may appropriately have the first coupler 70 illustrated in FIG. 1, and the first coupling portion 74 and the second coupling portion 75 illustrated in FIG. 4, depending on the configuration of the first antenna element group 81 and the like.

Each of the first antenna element group 81 and the second antenna element group 82 extends along the X direction. The first antenna element group 81 and the second antenna element group 82 are arranged along the Y direction. Each of the first antenna element group 81 and the second antenna element group 82 may have the same or similar configuration as an antenna element group illustrated in FIG. 6. The antenna element group illustrated in FIG. 6 includes the first antenna element 31, the second antenna element 32, the third antenna element 33, and the fourth antenna element 34.

The first antenna element group 81 includes antenna elements 331, 332, 333, and 334. Each of the antenna elements 331 to 343 may have the same or similar configuration as the first antenna element 31 or the second antenna element 32 illustrated in FIG. 1. The antenna elements 331, 332, 333, and 334 includes radiation conductors 341, 342, 343, and 344, respectively. Each of the radiation conductors 341 to 344 may have the same or similar configuration as the first radiation conductor 41 or the second radiation conductor 42 illustrated in FIG. 1.

The second antenna element group 82 includes antenna elements 335, 336, 337, and 338. Each of the antenna elements 335 to 338 may have the same or similar configuration as the first antenna element 31 or the second antenna element 32 illustrated in FIG. 1. The antenna elements 335, 336, 337, and 338 includes radiation conductors 345, 346, 347, and 348, respectively. Each of the radiation conductors 345 to 348 may have the same or similar configuration as the first radiation conductor 41 or the second radiation conductor 42 illustrated in FIG. 1.

Each of the antenna elements 331 to 338 may be configured to resonate in the same phase. Feeder lines of the antenna elements 331 to 338 may be configured to feed signals that excite the antenna elements 331 to 338 in the same phase. When the antenna elements 331 to 338 are excited in the same phase, the signals fed from the feeder lines of the antenna elements 331 to 338 to the antenna elements 331 to 338 may have the same phase. When the antenna elements 331 to 338 are excited in the same phase, the signals fed from the feeder lines of the antenna elements 331 to 338 to the antenna elements 331 to 338 may have different phases.

The antenna elements 331 to 338 may be configured to resonate in different phases. The feeder lines of the antenna elements 331 to 338 may be configured to feed the signals that excite the antenna elements 331 to 338 in different phases. When the antenna elements 331 to 338 are excited in different phases, the signals fed from the feeder lines of the antenna elements 331 to 338 to the antenna elements 331 to 338 may have the same phase. When the antenna elements 331 to 338 are excited in different phases, the signals fed from the feeder lines of the antenna elements 331 to 338 to the antenna elements 331 to 338 may have different phases.

In the first antenna element group 81, the antenna elements 331 to 334 are arranged along the X direction. The antenna elements 331 to 334 are arranged to be shifted in the Y direction in the same or similar manner as the configuration illustrated in FIG. 1. Of the antenna elements 331 to 334, the antenna element 332 and the antenna element 334 protrude toward the second antenna element group 82.

In the second antenna element group 82, the antenna elements 335 to 338 are arranged along the X direction. The antenna elements 335 to 338 are arranged to be shifted in the Y direction in the same or similar manner as the configuration illustrated in FIG. 1. Of the antenna elements 335 to 338, the antenna element 336 and the antenna element 338 protrude toward the first antenna element group 81.

At least one antenna element of the first antenna element group 81 is configured to be coupled to at least one antenna element of the second antenna element group 82 in the first coupling method such that one of the magnetic field coupling and the capacitive coupling is dominant. In the present embodiment, the radiation conductor 342 of the antenna element 332 of the first antenna element group 81 is configured to be capacitively coupled to the radiation conductor 346 of the antenna element 336 of the second antenna element group 82 in the first coupling method in which the capacitance coupling is dominant. For example, a short side 342*c* of the radiation conductor 342 and a short side 346*c* of the radiation conductor 346 face each other. The short side 342*c* and the short side 346*c* facing each other can configure a capacitor via the base 20. By configuring the capacitor, the radiation conductor 342 of the antenna element 332 is configured to be capacitively coupled to the radiation conductor 346 of the antenna element 336. In the same or similar manner, the radiation conductor 344 of the antenna element 334 of the first antenna element group 81 is configured to be coupled to the radiation conductor 348 of the antenna element 338 of the second antenna element group 82 by the first coupling method in which the capacitance coupling is dominant.

The first antenna element group 81 includes the radiation conductors 341, 342, 343, and 344 that serve as a first radiation conductor group 91. The second antenna element group 82 includes the radiation conductors 345, 346, 347, and 348 that serve as a second radiation conductor group 92.

In the first radiation conductor group 91, the radiation conductors 341 and the radiation conductors 342 that are adjacent to each other are arranged to be shifted in the Y direction in the same manner or similar manner as the configuration illustrated in FIG. 1. The radiation conductor 342 and the radiation conductor 343 that are adjacent to each other are arranged to be shifted in the Y direction. The radiation conductor 343 and the radiation conductor 344 that are adjacent to each other are arranged to be shifted in the Y direction.

In the second radiation conductor group 92, the radiation conductors 345 and the radiation conductors 346 that are adjacent to each other are arranged to be shifted in the Y direction in the same manner or similar manner as the configuration illustrated in FIG. 1. The radiation conductor 346 and the radiation conductor 347 that are adjacent to each other are arranged to be shifted in the Y direction. The radiation conductor 347 and the radiation conductor 348 that are adjacent to each other are arranged to be shifted in the Y direction.

The second coupler 76 is configured to couple the radiation conductor 342 of the first radiation conductor group 91 and the radiation conductor 346 of the second radiation conductor group 92 with a second coupling method different from the first coupling method. In the present embodiment, the second coupling method is a coupling method in which the magnetic field coupling is dominant. The second coupler 76 may include a coil or the like. By the second coupler 76 coupling the radiation conductor 342 and the radiation conductor 346 with the second coupling method, the mutual coupling between the radiation conductor 342 and the radiation conductor 346 can be reduced.

The second coupler 77 is configured to couple the radiation conductor 344 of the first radiation conductor group 91 and the radiation conductor 348 of the second radiation conductor group 92 with the second coupling method. The second coupler 77 may include a coil or the like. By the second coupler 77 coupling the radiation conductor 344 and the radiation conductor 348 with the second coupling method, the mutual coupling between the radiation conductor 344 and the radiation conductor 348 can be reduced.

Figure 8:
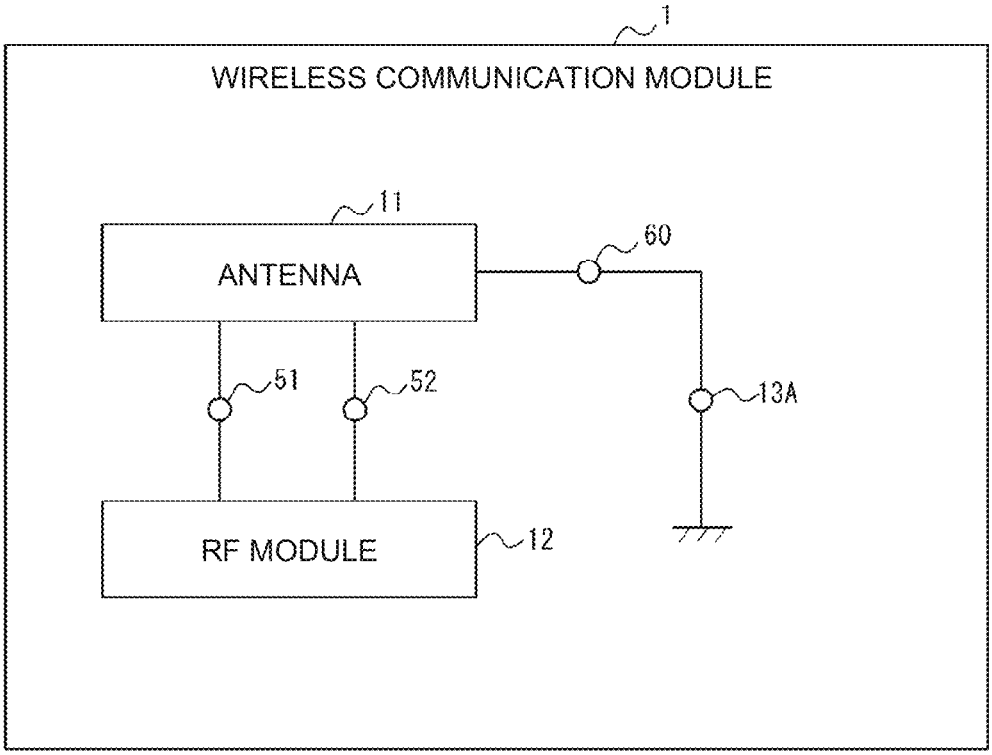
FIG. 8 is a block diagram of a wireless communication module according to an embodiment.
Figure 9:
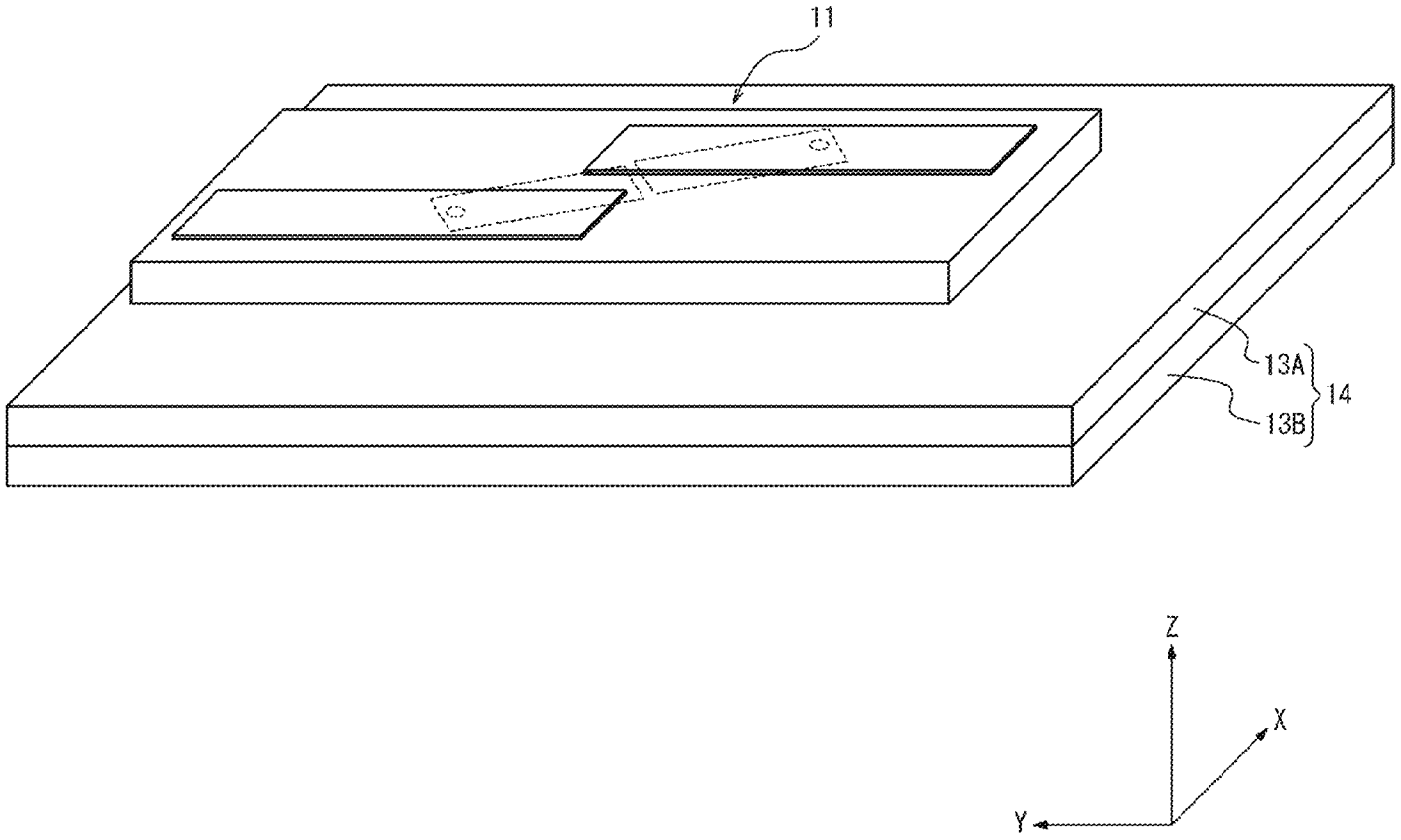
FIG. 9 is a schematic configuration view of the wireless communication module illustrated in FIG. 8.

FIG. 8 is a block diagram of a wireless communication module 1 according to an embodiment. FIG. 9 is a schematic configuration view of the wireless communication module 1 illustrated in FIG. 8.

The wireless communication module 1 includes an antenna 11, an RF module 12, and a circuit board 14. The circuit board 14 has a ground conductor 13A and a printed circuit board 13B.

The antenna 11 includes the antenna 10 illustrated in FIG. 1. However, the antenna 11 may include any of the antenna 110 illustrated in FIG. 7, the antenna 210 illustrated in FIG. 8, and the antenna 310 illustrated in FIG. 9 instead of the antenna 10 illustrated in FIG. 1. The antenna 11 has the first feeder line 51 and the second feeder line 52. The antenna 11 has a ground conductor 60. The ground conductor 60 is configured by integrating the first ground conductor 61 and the second ground conductor 62 illustrated in FIG. 2.

The antenna 11 is located on the circuit board 14 as illustrated in FIG. 9. The first feeder line 51 of the antenna 11 is configured to be connected to the RF module 12 illustrated in FIG. 8 via the circuit board 14 illustrated in FIG. 9. The second feeder line 52 of the antenna 11 is configured to be connected to the RF module 12 illustrated in FIG. 8 via the circuit board 14 illustrated in FIG. 9. The ground conductor 60 of the antenna 11 is configured to be electromagnetically connected to the ground conductor 13A included in the circuit board 14.

The antenna 11 is not limited to the one having both the first feeder line 51 and the second feeder line 52. The antenna 11 may have one feeder line of the first feeder line 51 and the second feeder line 52. When the antenna 11 has one feeder line of the first feeder line 51 and the second feeder line 52, the configuration of the circuit board 14 can be appropriately changed according to the configuration of the antenna 11 having one feeder line. For example, the RF module 12 may have only one connection terminal. For example, the circuit board 14 may have one conductive wire configured to connect the connection terminal of the RF module 12 and the feeder line of the antenna 11.

The ground conductor 13A may include a conductive material. The ground conductor 13A can extend in the XY plane.

The antenna 11 may be integrated with the circuit board 14. In the configuration in which the antenna 11 and the circuit board 14 are integrated, the ground conductor 60 of the antenna 11 may be integrated with the ground conductor 13A of the circuit board 14.

The RF module 12 is configured to control power fed to the antenna 11. The RF module 12 is configured to modulate a baseband signal and supply the modulated baseband signal to the antenna 11. The RF module 12 is configured to modulate an electrical signal received by the antenna 11 into the baseband signal.

The wireless communication module 1 can efficiently radiate electromagnetic waves by including the antenna 11.

Figure 10:
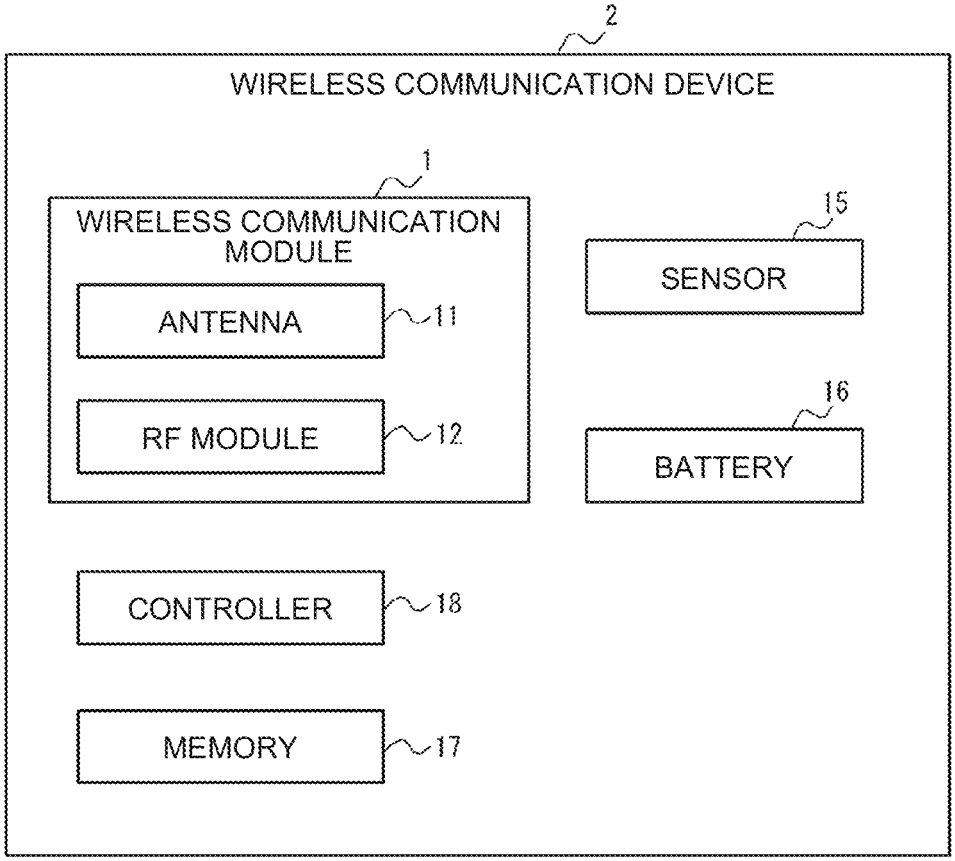
FIG. 10 is a block diagram of a wireless communication device according to an embodiment.
Figure 11:
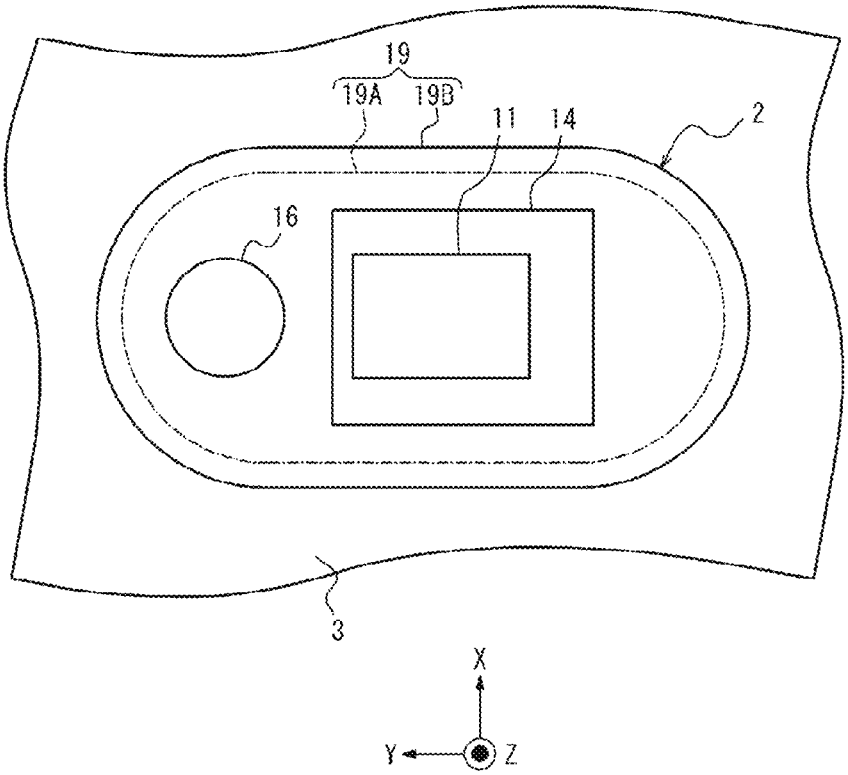
FIG. 11 is a plan view of the wireless communication device illustrated in FIG. 10.
Figure 12:
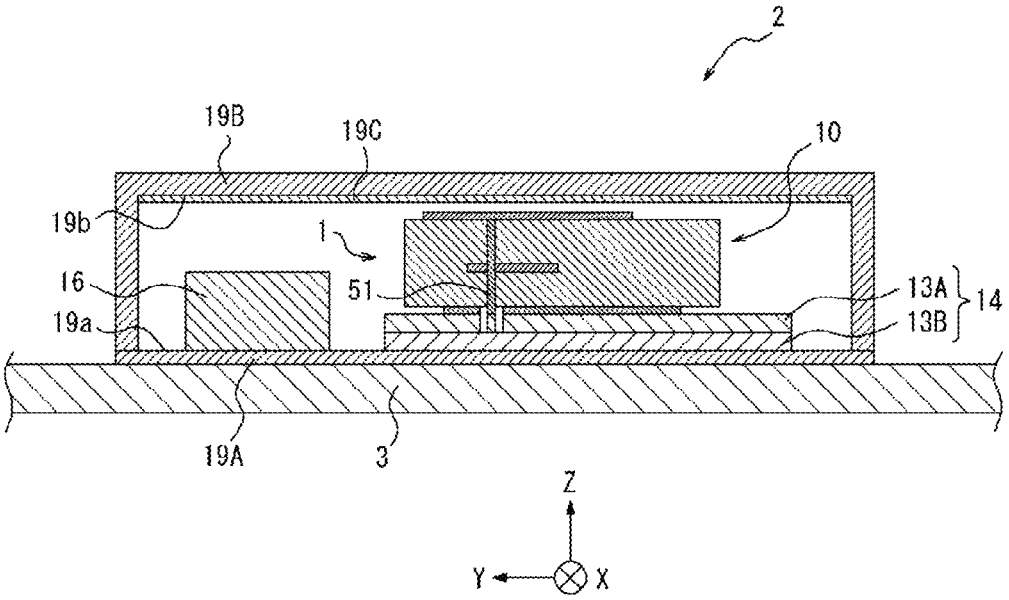
FIG. 12 is a cross-sectional view of the wireless communication device illustrated in FIG. 10.

FIG. 10 is a block diagram of a wireless communication device 2 according to an embodiment. FIG. 11 is a plan view of the wireless communication device 2 illustrated in FIG. 10. FIG. 12 is a cross-sectional view of the wireless communication device 2 illustrated in FIG. 10.

The wireless communication device 2 can be located on a board 3. A material of the board 3 may be any material. As illustrated in FIG. 10, the wireless communication device 2 includes the wireless communication module 1, a sensor 15, a battery 16, a memory 17, and a controller 18. As illustrated in FIG. 11, the wireless communication device 2 includes a housing 19.

The sensor 15 may include, for example, a speed sensor, a vibration sensor, an acceleration sensor, a gyro sensor, a rotation angle sensor, an angular velocity sensor, a geomagnetic sensor, a magnet sensor, a temperature sensor, a humidity sensor, an atmospheric pressure sensor, an optical sensor, an illuminance sensor, a UV sensor, a gas sensor, a gas concentration sensor, an atmosphere sensor, a level sensor, an odor sensor, a pressure sensor, an air pressure sensor, a contact sensor, a wind power sensor, an infrared sensor, a human sensor, a displacement sensor, an image sensor, a weight sensor, a smoke sensor, a liquid leakage sensor, a vital sensor, a battery remaining amount sensor, an ultrasonic sensor, or a global positioning system (GPS) signal receiving device, or the like.

The battery 16 is configured to supply power to the wireless communication module 1. The battery 16 may be configured to supply the power to at least one of the sensor 15, the memory 17, and the controller 18. The battery 16 may include at least one of a primary battery and a secondary battery. A negative electrode of the battery 16 is configured to be electrically connected to the ground terminal of the circuit board 14 illustrated in FIG. 9. The negative electrode of the battery 16 is configured to be electrically connected to the ground conductor 60 of the antenna 11.

The memory 17 can include, for example, a semiconductor memory or the like. The memory 17 may be configured to function as a work memory of the controller 18. The memory 17 can be included in the controller 18. The memory 17 stores a program that describes processing contents for implementing each function of the wireless communication device 2, information used for processing in the wireless communication device 2, and the like.

The controller 18 can include, for example, a processor. The controller 18 may include one or more processors. The processor may include a general-purpose processor that loads a specific program and executes a specific function, and a dedicated processor that is specialized for specific processing. The dedicated processor may include an application specific IC. The application specific IC is also called an application specific integrated circuit (ASIC). The processor may include a programmable logic device. The programmable logic device is also called a programmable logic device (PLD). The PLD may include a field-programmable gate array (FPGA). The controller 18 may be either a system-on-a-chip (SoC) in which one or a plurality of processors cooperate, and a system in a package (SiP). The controller 18 may store various kinds of information, a program for operating each component of the wireless communication device 2, or the like in the memory 17.

The controller 18 is configured to generate a transmission signal transmitted from the wireless communication device 2. The controller 18 may be configured to acquire measurement data from, for example, the sensor 15. The controller 18 may be configured to generate a transmission signal according to the measurement data. The controller 18 can be configured to transmit a baseband signal to the RF module 12 of the wireless communication module 1.

The housing 19 illustrated in FIG. 11 is configured to protect other devices of the wireless communication device 2. The housing 19 may include a first housing 19A and a second housing 19B.

The first housing 19A illustrated in FIG. 12 can extend in the XY plane. The first housing 19A is configured to support other devices. The first housing 19A may be configured to support the wireless communication device 2. The wireless communication device 2 is located on an upper surface 19*a* of the first housing 19A. The first housing 19A may be configured to support the battery 16. The battery 16 is located on the upper surface 19*a* of the first housing 19A. The wireless communication module 1 and the battery 16 may be arranged along the X direction on the upper surface 19*a* of the first housing 19A.

The second housing 19B illustrated in FIG. 12 may be configured to cover other devices. The second housing 19B includes a lower surface 19*b* located on the negative direction side of the Z axis of the antenna 11. The lower surface 19*b* extends along the XY plane. The lower surface 19*b* is not limited to being flat and can include irregularities. The second housing 19B may have a conductor member 19C. The conductor member 19C is located on at least one of the interior, the outside, and the inside of the second housing 19B. The conductor member 19C is located on at least one of the upper surface and the side surface of the second housing 19B.

The conductor member 19C illustrated in FIG. 12 faces the antenna 11. The antenna 11 can be coupled to the conductor member 19C to radiate the electromagnetic waves by using the conductor member 19C as a secondary radiator. When the antenna 11 and the conductor member 19C face each other, the capacitive coupling between the antenna 11 and the conductor member 19C can be increased. When a current direction of the antenna 11 is along the extending direction of the conductor member 19C, the electromagnetic coupling between the antenna 11 and the conductor member 19C can be increased. This coupling can be a mutual inductance.

The configuration according to the present disclosure is not limited to the embodiments described above, and various modifications or changes can be made. For example, the functions and the like included in each component can be rearranged so as not to logically contradict each other, and a plurality of components can be combined into one or divided.

For example, in the above-described embodiments as illustrated in FIG. 7, the second coupler 76 is described as being located on the negative direction side of the Z axis as compared to the radiation conductor 342 and the radiation conductor 346. However, the second coupler 76 does not have to be located on the negative direction side of the Z axis if it is configured to couple the radiation conductor 342 and the radiation conductor 346 with the second coupling method. For example, the second coupler 76 may be located on the positive direction side of the Z axis as compared to the radiation conductor 342 and the radiation conductor 346. In the same as or similar to the second coupler 76, the second coupler 77 illustrated in FIG. 7 does not have to be located on the negative direction side of the Z axis if it is configured to couple the radiation conductor 344 and the radiation conductor 348 with the second coupling method.

The diagrams illustrating the configuration according to the present disclosure are schematic. The dimensional ratios and the like on the drawings do not always match the actual ones.

In the present disclosure, the terms "first", "second", "third" and so on are examples of identifiers meant to distinguish the configurations from each other. In the present disclosure, regarding the configurations distinguished by the terms "first" and "second", the respective identifying numbers can be reciprocally exchanged. For example, regarding a first frequency and a second frequency, the identifiers "first" and "second" can be reciprocally exchanged. The exchange of identifiers is performed simultaneously. Even after exchanging the identifiers, the configurations remain distinguished from each other. Identifiers may be removed. The configurations from which the identifiers are removed are still distinguishable by the reference numerals. In the present disclosure, the terms "first", "second", and so on of the identifiers should not be used in the interpretation of the order of the configurations, or should not be used as the basis for having identifiers with low numbers, or should not be used as the basis for having identifies with high numbers.

The invention claimed is:

1. An antenna comprising:

a first antenna element that includes a first radiation conductor and a first feeder line and is configured to resonate in a first frequency band;

a second antenna element that includes a second radiation conductor and a second feeder line and is configured to resonate in a second frequency band; and a first coupler, wherein the second feeder line is configured to be coupled to the first feeder line such that a first component is dominant, the first component being one of a capacitance component and an inductance component, the first coupler is configured to couple the first feeder line and the second feeder line such that a second component different from the first component is dominant, the first radiation conductor and the second radiation conductor are arranged at an interval equal to or less than ½ of a resonance wavelength of the antenna in a first direction, and the first radiation conductor and the second radiation conductor are arranged to be shifted in a second direction intersecting the first direction.

2. The antenna according to claim 1, wherein the first frequency band and the second frequency band belong to the same frequency band.

3. The antenna according to claim 1, wherein the first frequency band and the second frequency band belong to different frequency bands.

4. The antenna according to claim 1, wherein the first antenna element further includes a first ground conductor.

5. The antenna according to claim 4, wherein the second antenna element further includes a second ground conductor.

6. The antenna according to claim 5, wherein the first ground conductor is connected to the second ground conductor.

7. The antenna according to claim 5, wherein the first ground conductor and the second ground conductor are formed integrally, and the first ground conductor and the second ground conductor are integrated with a single base.

8. The antenna according to claim 1, further comprising a first coupling portion configured to couple the first radiation conductor and the second feeder line.

9. The antenna according to claim 8, wherein the first coupling portion is configured to couple the first radiation conductor and the second feeder line such that the second component is dominant.

10. The antenna according to claim 1, further comprising a second coupling portion configured to couple the second radiation conductor and the first feeder line.

11. The antenna according to claim 10, wherein the second coupling portion is configured to couple the second radiation conductor and the first feeder line such that the second component is dominant.

12. The antenna according to claim 1, further comprising a plurality of antenna elements including the first antenna element and the second antenna element, wherein the plurality of antenna elements are arranged along the first direction, and adjacent antenna elements included in the plurality of antenna elements are arranged to be shifted in the second direction.

13. The antenna according to claim 12, wherein the plurality of antenna elements are arranged in the first direction at intervals equal to or less than ¼ of a resonance wavelength.

14. The antenna according to claim 12, wherein the plurality of antenna elements include an n-th antenna element that includes an n-th radiation conductor and an n-th feeder line and is configured to resonate in a first frequency band, n being an integer of 3 or more, and the n-th radiation conductor is arranged with the first radiation conductor in the first direction at an interval equal to or less than ½ of a resonance wavelength.

15. The antenna according to claim 14, wherein the n-th radiation conductor is configured to be directly or indirectly coupled to the second radiation conductor.

16. The antenna according to claim 12, wherein the plurality of antenna elements includes a first antenna element group arranged in the first direction, and a second antenna element group arranged in the first direction, and at least one antenna element of the first antenna element group is configured to be coupled to at least one antenna element of the second antenna element group with a first coupling method in which one of a magnetic field coupling and an electric field coupling is dominant.

17. The antenna according to claim 16, further comprising a second coupler configured to couple, with a second coupling method different form the first coupling method, the at least one antenna element of the first antenna element group and the at least one antenna element of the second antenna element group that are coupled with the first coupling method, wherein the first antenna element group includes a first radiation conductor group, the second antenna element group includes a second radiation conductor group, and adjacent radiation conductors included in the first radiation conductor group are arranged to be shifted in the second direction.

18. The antenna according to claim 17, wherein adjacent radiation conductors included in the second radiation conductor group are arranged to be shifted in the second direction.

19. A wireless communication module comprising:

the antenna according to claim 1; and an RF module configured to be electrically connected to at least one of the first feeder line and the second feeder line.

20. A wireless communication device comprising:

the wireless communication module according to claim 19; and a battery configured to supply power to the wireless communication module.

* * * * *